US011326569B2

(12) United States Patent
Perr

(10) Patent No.: US 11,326,569 B2
(45) Date of Patent: May 10, 2022

(54) FUEL INJECTOR MOUNTING ASSEMBLY FOR AN OPPOSED-PISTON ENGINE

(71) Applicant: ACHATES POWER, INC., San Diego, CA (US)

(72) Inventor: Andrew P. Perr, Columbus, IN (US)

(73) Assignee: Achates Power, Inc., San Diego, CA (US)

( * ) Notice: Subject to any disclaimer, the term of this patent is extended or adjusted under 35 U.S.C. 154(b) by 375 days.

(21) Appl. No.: 16/694,861

(22) Filed: Nov. 25, 2019

(65) Prior Publication Data

US 2021/0156349 A1 May 27, 2021

(51) Int. Cl.

| | |
|---|---|
| ***F02M 61/14*** | (2006.01) |
| ***F02B 75/28*** | (2006.01) |
| ***F02F 1/18*** | (2006.01) |
| ***F02F 7/00*** | (2006.01) |
| ***F02F 11/00*** | (2006.01) |

(52) U.S. Cl.

CPC ..... *F02M 61/14* (2013.01); *F02B 75/28* (2013.01); *F02F 1/186* (2013.01); *F02F 7/0068* (2013.01); *F02F 11/005* (2013.01); *F02B 2275/14* (2013.01); *F02M 2200/858* (2013.01)

(58) Field of Classification Search

CPC ..... F02M 61/14; F02M 2200/85; F02M 2200/855; F02M 2200/858; F02B 75/28; F02B 2275/14; F02F 1/186

USPC ..... 123/470

See application file for complete search history.

(56) References Cited

U.S. PATENT DOCUMENTS

| | | | | |
|---|---|---|---|---|
| 3,845,748 | A | 11/1974 | Eisenberg | |
| 3,993,030 | A * | 11/1976 | Jaulmes | F02M 53/08 123/470 |
| 4,048,970 | A * | 9/1977 | Fitzgerald | F02B 71/02 123/457 |
| 4,246,877 | A | 1/1981 | Kennedy | |
| 4,506,645 | A * | 3/1985 | Hewlitt | F02M 61/14 123/470 |
| 4,860,710 | A * | 8/1989 | Hafner | F02M 61/145 123/470 |
| 5,494,220 | A * | 2/1996 | Shinogle | F02M 61/14 239/88 |
| 5,984,208 | A | 11/1999 | Martin et al. | |
| 6,170,442 | B1 * | 1/2001 | Beale | F02D 13/0215 123/46 B |
| 6,367,444 | B1 | 4/2002 | Yonezawa et al. | |
| 6,415,768 | B1 | 7/2002 | Usul | |
| 6,446,597 | B1 * | 9/2002 | McAlister | F02B 3/06 123/296 |
| 7,108,206 | B2 * | 9/2006 | Yacoub | F02M 47/027 137/625.5 |

(Continued)

*Primary Examiner* — Phutthiwat Wongwian
*Assistant Examiner* — Arnold Castro
(74) *Attorney, Agent, or Firm* — Terrance A. Meador

(57) ABSTRACT

A fuel injector mounting assembly in an opposed-piston engine allows for mounting of a fuel injector in a cylinder block without significantly deforming the wall of the cylinder into which the injector is configured to deliver fuel. The fuel injector mounting assembly includes a clamping arrangement to clamp the fuel injector to the cylinder block, an elongate tubular sleeve that sheathes a nozzle portion of the fuel injector, and a spanner nut attached to the elongate tubular sleeve. Clamping loads applied to retain the fuel injector in the cylinder block are controlled by the spanner nut.

20 Claims, 4 Drawing Sheets

(56) References Cited

U.S. PATENT DOCUMENTS

| | | | | |
|---|---|---|---|---|
| 7,114,489 | B2 | 10/2006 | Wenke | |
| 8,499,729 | B2 * | 8/2013 | Carlson | F02M 61/14 123/56.1 |
| 8,997,710 | B2 | 4/2015 | Herold et al. | |
| 9,863,384 | B1 * | 1/2018 | Eves | F02F 1/004 |
| 2001/0007338 | A1 * | 7/2001 | Popp | F02M 21/0251 239/132.5 |
| 2011/0259304 | A1 * | 10/2011 | Lowi | F02B 75/28 123/51 R |
| 2013/0104848 | A1 | 5/2013 | Klyza et al. | |
| 2019/0153986 | A1 * | 5/2019 | Serra | F02M 61/14 |

* cited by examiner

FUEL INJECTOR MOUNTING ASSEMBLY FOR AN OPPOSED-PISTON ENGINE

STATEMENT REGARDING FEDERALLY SPONSORED RESEARCH

This Project Agreement Holder (PAH) invention was made with U.S. Government support under Agreement No. W15KQN-14-9-1002 awarded by the U.S. Army Contracting Command-New Jersey (ACC-NJ) Contracting Activity to the National Advanced Mobility Consortium. The Government has certain rights in the invention.

FIELD OF THE INVENTION

The field of the invention relates to opposed-piston engines equipped with fuel injectors. More specifically, the field of the invention concerns a fuel injector assembly uniquely constructed to mount a fuel injector to the cylinder block of an opposed-piston engine for direct side injection of fuel into a cylinder.

BACKGROUND

An opposed-piston engine is an internal-combustion engine characterized by an arrangement of two pistons disposed in the bore of a cylinder for reciprocating movement in opposing directions along a longitudinal axis of the cylinder. An opposed-piston, internal combustion engine differs in many respects from a conventional internal combustion engine, which has a single piston in a cylinder. In an opposed-piston engine, a combustion chamber is formed between the end surfaces of two opposed pistons in a zone of a cylinder, where combustion occurs; in a conventional engine, a combustion chamber is formed between a cylinder head and the end surface of the single piston moving in the cylinder. In an opposed-piston engine, air enters a cylinder through a piston-controlled intake port in the cylinder, near one of its two ends, and exhaust exits the cylinder through a piston-controlled exhaust port that opens through the cylinder, near the other of its two ends. In a conventional engine air and exhaust pass through one end of the cylinder via respective valve-controlled intake and exhaust ports in the cylinder head.

In a conventional engine with fuel injection, a fuel injector for a cylinder is mounted to the cylinder head, in close proximity to the cylinder's intake and exhaust ports. The fuel injector is positioned to inject a plume of fuel into the bore of the cylinder, through the end of the cylinder that seats against the cylinder head. In these cases the direction of fuel injection is toward the end surface of the piston, usually along the longitudinal axis of the cylinder. In an opposed-piston engine, the combustion chamber is defined in an intermediate portion of the cylinder, between the cylinder's intake and exhaust ends. A fuel injector is typically located adjacent to the sidewall in the intermediate portion of the cylinder, between respective top center (TC) locations of the piston end surfaces, with its nozzle oriented toward the cylinder's longitudinal bore axis. This results in a direct side injection configuration that is characteristic of opposed-piston engine design. That is to say, fuel is injected directly into the combustion chamber, through the sidewall of the cylinder, across (transverse to) the longitudinal bore axis.

In a conventional internal combustion engine equipped with a fuel injection system, a fuel injector is typically mounted to, and retained on, the cylinder head by means of a clamping arrangement that acts between the fuel injector and the cylinder head. Such a clamping arrangement exerts forces on the deck of the cylinder head, such that the deck face of the cylinder head may bulge or bow into the combustion chamber. These deformations occur in the cylinder head, and have little or no effect on the cylinder itself.

In an opposed-piston engine, there is no cylinder head where a fuel injector can be mounted. Instead, a fuel injector is typically mounted to a cylinder block, at a location containing a section of the cylinder wall where the combustion chamber is formed, that is to say, in the intermediate portion of the cylinder, far away from both the intake port and the exhaust port. Care must be taken to ensure that any means designed for mounting a fuel injector not deform the cylinder wall to such a degree that the bore distorts from some desired shape designed for an optimal sliding piston/bore interface. Such distortions can cause scuffing in the piston/cylinder bore interface, which can reduce the engine's durability and operational lifetime.

Accordingly, there is a need for a fuel injector assembly constructed to mount a fuel injector on the cylinder block of an opposed-piston engine and retain the fuel injector in operative communication with the bore of a cylinder, while causing little or no distortion of the cylinder bore.

SUMMARY OF THE INVENTION

A fuel injector mounting assembly for mounting a fuel injector on the cylinder block of an opposed-piston engine includes a sleeve, a clamp, threaded fasteners, and a spanner nut. The sleeve sheathes at least a nozzle portion of the fuel injector. The clamp has a first opening for the fuel injector and openings to accommodate the threaded fasteners. The threaded fasteners pass through the openings in the clamp to be secured in threaded openings in the cylinder block of the opposed-piston engine. The spanner nut is configured to be threadedly received on the sleeve and seated against the cylinder block in such a way as to resist or diminish an axial force applied to the fuel injector by the clamp which would otherwise be directed against a cylinder wall.

An opposed-piston engine includes the fuel injector mounting assembly described herein. Such an opposed-piston engine includes a cylinder block and the fuel injector mounting assembly with a sleeve, a clamp, threaded fasteners, and a spanner nut. The cylinder block has at least one cylinder, a recess for receiving the fuel injector with the sleeve, and threaded securing openings to receive the threaded fasteners. The spanner nut is configured to be threadedly received on the sleeve and seated against the cylinder block in such a way as to resist or diminish an axial force applied to the fuel injector by the clamp. An opposed-piston engine configuration with a fuel injector mounting assembly and cylinder block according to the invention reduces or eliminates cylinder bore deformation that is attributable to the presence of fuel injectors.

DETAILED DESCRIPTION

In an uniflow-scavenged, two-stroke opposed-piston engine, a fuel injector mounting assembly is used to mount and retain a fuel injector on a cylinder block, in operative fuel injecting communication with a cylinder of the engine. The fuel injector mounting assembly is configured to reduce, or prevent, cylinder bore distortion associated with, or caused by, damping forces acting against the fuel injector in the direction of the cylinder. Embodiments of the fuel injector mounting assembly and its components are described herein, as is a representative opposed-piston engine configuration that incorporates a fuel injector mounting assembly according to the invention.

Figure 1:
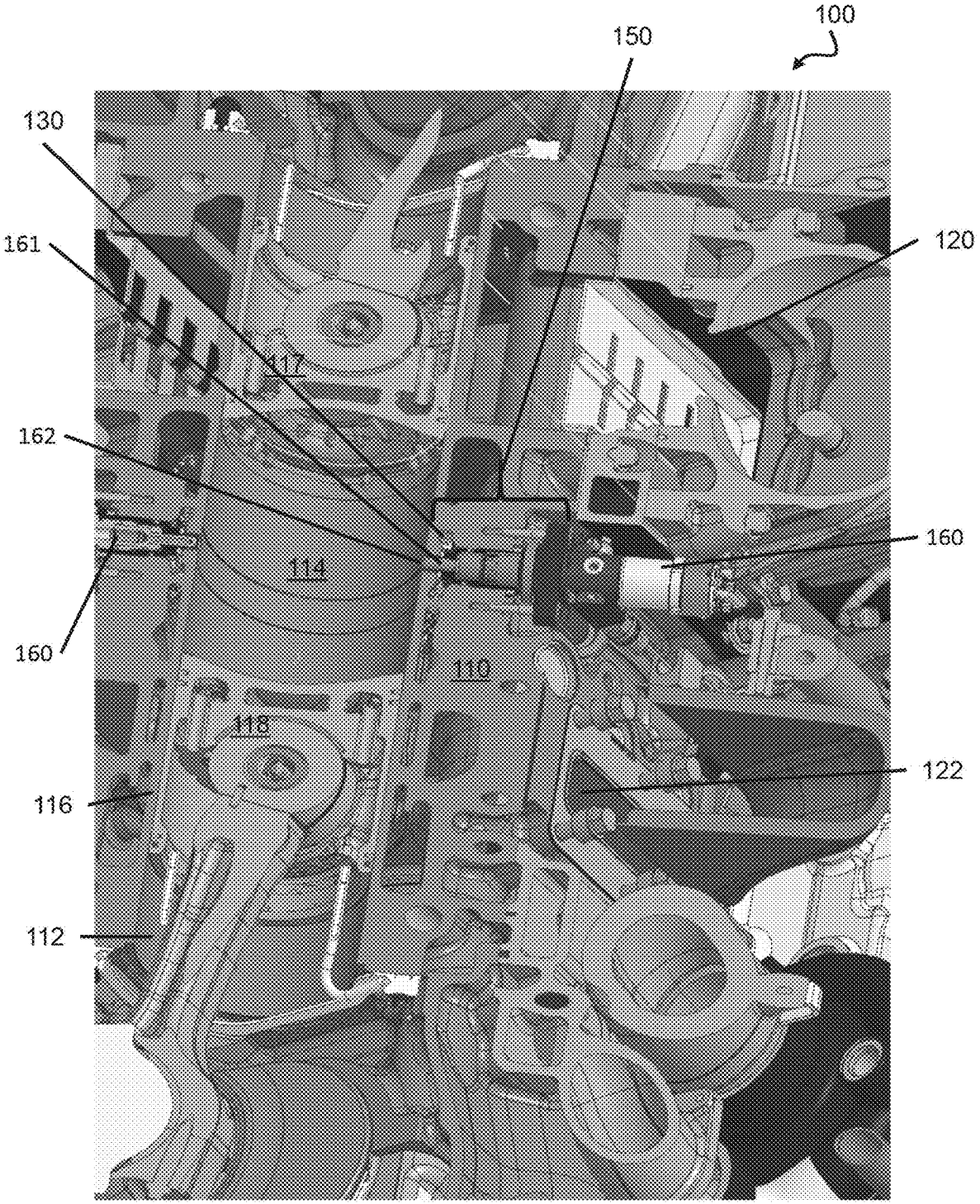
FIG. 1 is a partially schematic, sectional view of an opposed-piston engine that shows a fuel injector mounted to a cylinder block of the engine according to the invention.

FIG. 1 shows a section of an opposed-piston, internal combustion engine 100 with a fuel injector mounting assembly 150 retaining a fuel injector 160, according to the invention. The opposed-piston engine 100 includes a cylinder block 110 comprising at least one cylinder 112 with opposing pistons 117, 118; an intake plenum 120; an exhaust plenum 122; and a fuel injector mounting assembly 150. The cylinder 112 includes a bore 114 in which the pistons 117, 118 reciprocate in opposite directions during each cycle of engine operation. The cylinder bore 114 is defined by a cylinder wall 116. A nozzle 161 of the fuel injector 160 has a tip positioned at an aperture 162 in the cylinder wall 116, thereby putting the fuel injector 160 in operative fuel-provisioning communication with the cylinder bore 114 such that the fuel injector 160 is able to inject fuel, through the aperture 162, into the cylinder bore 114. Adjacent to the cylinder wall 116 and the nozzle 161 of the fuel injector 160 is a coolant passage 130 formed in the cylinder block 110 to transport liquid coolant past the fuel injector 160.

Figure 2:
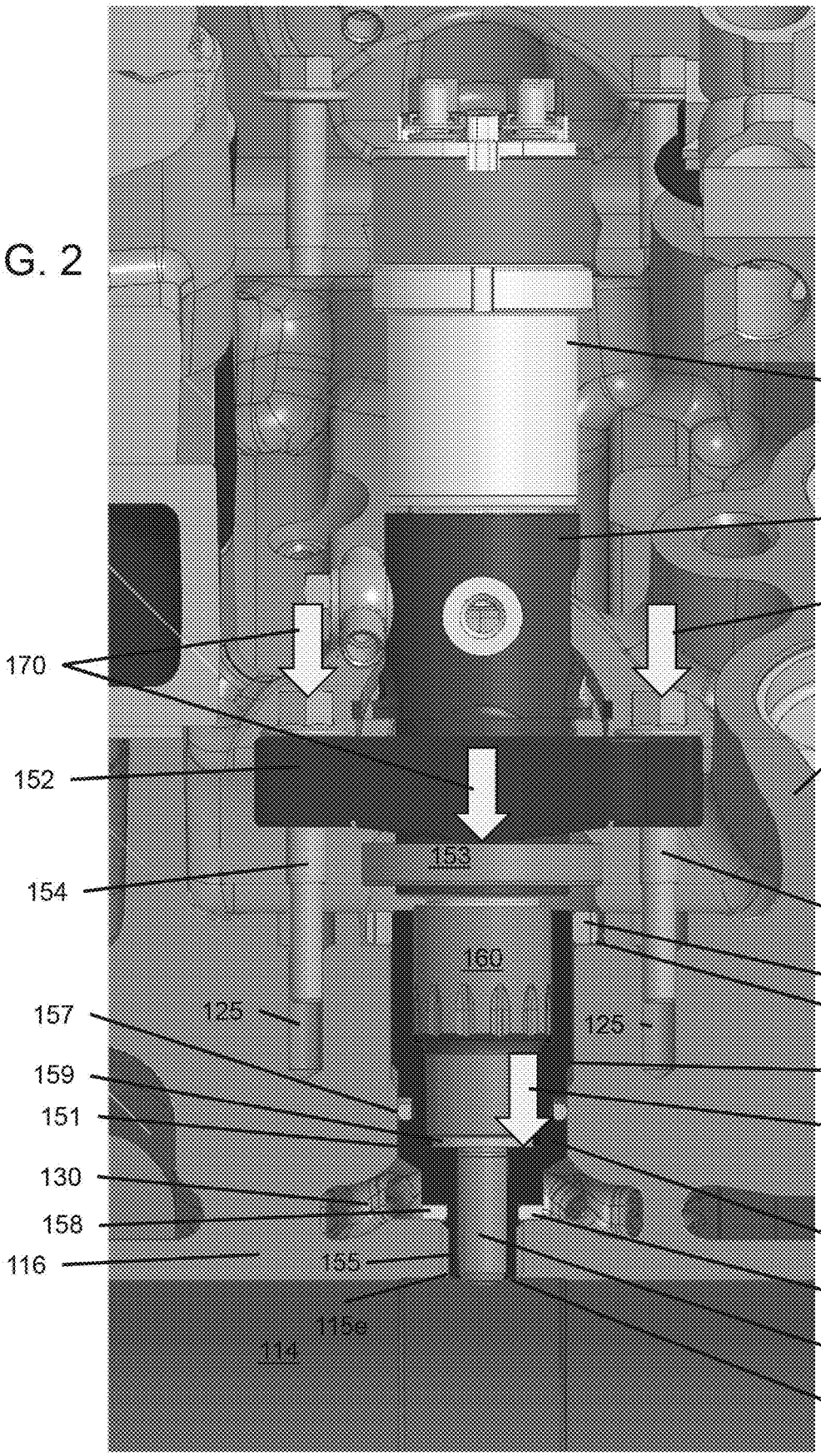
FIG. 2 is an enlarged view of a portion of the engine of FIG. 1 that shows an exemplary fuel injector mounting assembly according to the invention.
Figure 3:
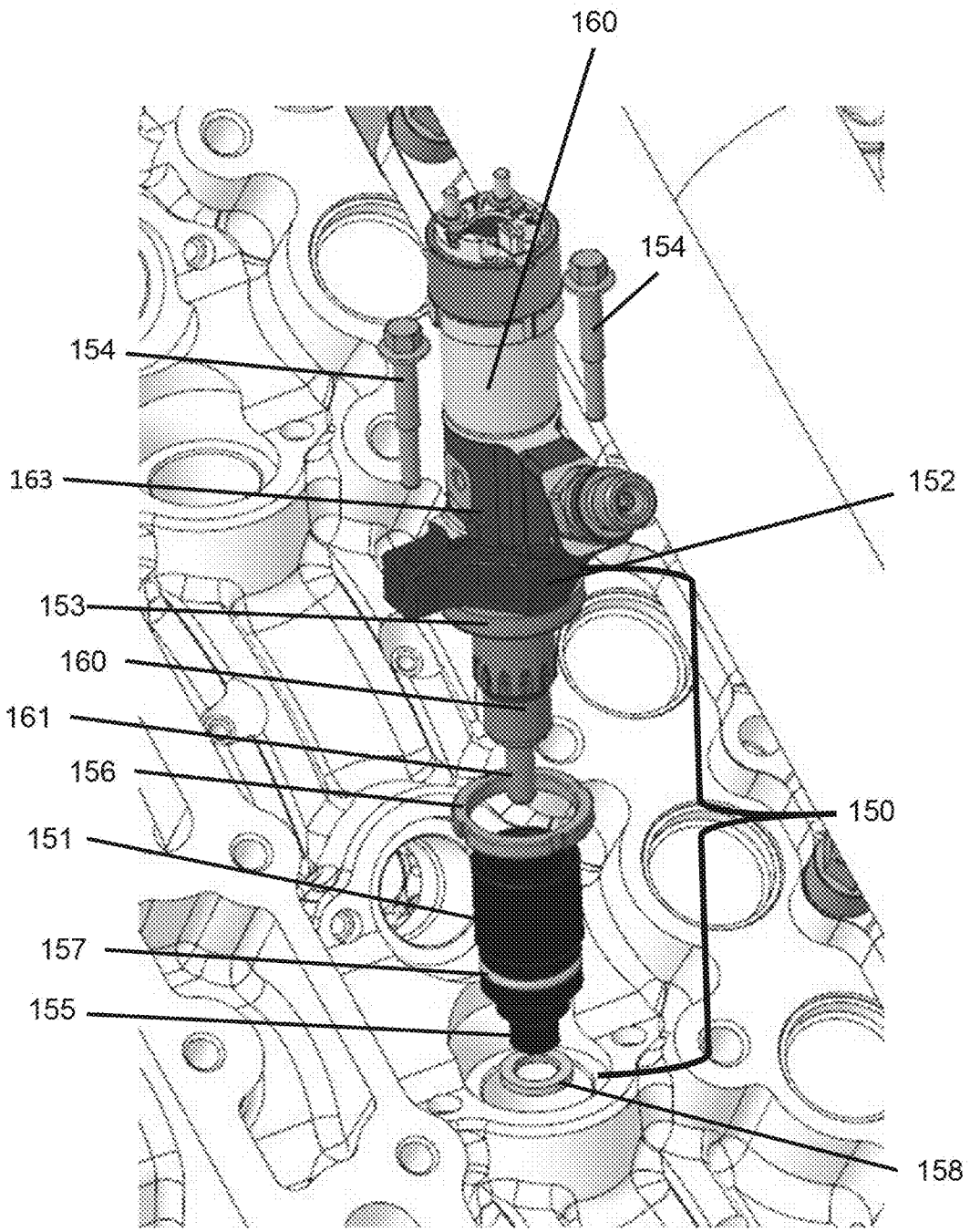
FIG. 3 is an exploded view of the fuel injector mounting assembly of FIG. 2.
Figure 4:
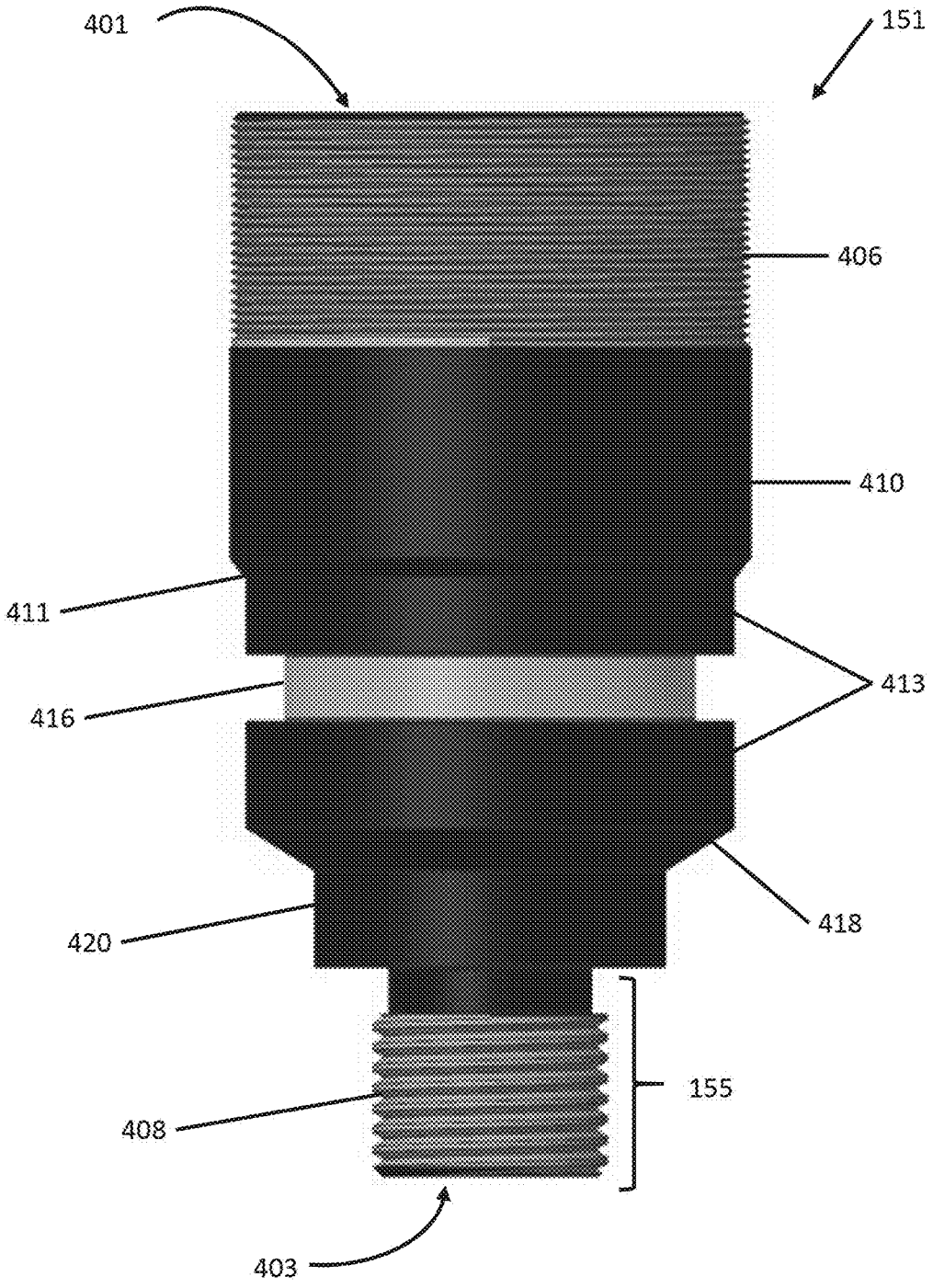
FIG. 4 is an enlarged side view of an exemplary elongate tubular sleeve of the fuel injector mounting assembly according to the invention.

FIG. 2 is an enlarged view that, shows an exemplary fuel injector mounting assembly embodiment. FIG. 3 is an exploded view of the exemplary fuel injector mounting assembly. FIG. 4 is a side elevation view of a sleeve of the fuel injector mounting assembly enlarged to make certain features visible. With reference now to FIGS. 2, 3, and 4, the fuel injector mounting assembly 150 includes a sleeve 151, a clamping arrangement comprising a yoke-type clamp 152, a collar 153, and threaded fasteners 154, and a spanner nut 156. Sealing elements, including an O-ring 157, a first washer 158, and a second washer 159, prevent leakage of fluids past the sleeve 151. The sleeve is an elongate tubular sleeve 151 having a shape that corresponds to an elongate cylindrical shape of a portion of the fuel injector 160 that includes the nozzle 161.

The fuel injector is clamped to the cylinder block 110 by means of a clamping arrangement that secures the fuel injector 160, sheathed with the elongate tubular sleeve 151, to the cylinder block 110. In this regard, the yoke-type damp 152 is received on the fuel injector 160, and extends radially outwardly an either side of the injector 160. The clamp 152 abuts against a fitting 163 of the injector where fuel lines connect. The clamp 152 is held against the fitting 163 by a collar 153 which is retained in position by one or more snap ring retainers (not seen) acting between the collar 153 and the fuel injector 160. The threaded fasteners 154 extend through the clamp 152 to internally-threaded drillings 125 formed in in the cylinder block. Washers are clamped between the heads of the fasteners 154 and an adjacent surface of the clamp 152.

As per FIG. 4, the elongate tubular sleeve 151 has a first end 401 defining an opening for insertably receiving the nozzle portion of the fuel injector 160 (FIGS. 1 and 2) and a second end 403 configured to receive the nozzle 161 of the nozzle portion (FIGS. 1 and 2). The outer surface of the elongate tubular sleeve 151 is threaded at each end. First threads 406 are formed on an exterior surface portion of the sleeve 151 at the first end 401, and second threads 408 are formed on an exterior surface portion of the sleeve 151 at the second end 403. The shape of the elongate tubular sleeve 151 includes an upper substantially cylindrical portion 410 that tapers through a first generally frusto-conical shoulder portion 411 to a substantially cylindrical midsection 413 in which an exterior circumferential groove 416 is formed. The substantially cylindrical midsection 413 tapers through a second generally frusta-conical shoulder portion 418 to a first substantially cylindrical end portion 420, which steps down to a second, narrower substantially cylindrical end portion 155. With reference to FIGS. 2 and 4, the shape of the elongate tubular sleeve 151 enables it to receive and sheathe the nozzle end of the fuel injector 160, with the nozzle 161 disposed in the second substantially cylindrical end portion 155.

Referring again to FIGS. 2, 3, and 4, the cylinder block 110 has a recess 115 internally shaped to conform to the shape of the elongate tubular sleeve 151. The recess 115 widens at one end to define an annular groove 126. The opposite end **115*e* of the recess 115 opens through the cylinder wall 116, providing the aperture 162 through which fuel is injected to the cylinder bore 114. The interior surface of the recess 115 at the end 115*e* is threaded. The elongate tubular sleeve 151 is inserted into the recess 115 and is seated and retained therein by threading the second threads 408 of the substantially cylindrical end portion 155 into the threaded end 115*e* of the recess 115. The spanner nut 156 is threaded on an inner circumference (not seen) so as to be threaded onto the first threads 406 on the exterior surface portion of the sleeve 151 at the first end 401. When the elongate tubular sleeve 151 is seated in the recess 115 by the threaded engagement of the second threads 408 with the threaded end 115*e*, the spanner nut 156 is threaded onto the first threads 406 and turned thereon until tightly seated against the groove 126**.

As may be understood with reference to FIG. 2, when the elongate tubular sleeve 151 is inserted into the recess 115, the coolant passage 130 includes an annular cooling gallery surrounding the elongate tubular sleeve 151 at the first substantially cylindrical end portion 420 through which liquid coolant is circulated. Further, the high pressures in the bore that are produced during compression and combustion encourage leakage from the bore of the cylinder to the coolant passage 130 and to the atmosphere. Consequently, it is useful to provide sealing assistance to prevent leakage of fluid along the external and internal surfaces of the sleeve.

The O-ring 157, which may comprise an elastomeric ring, is received in the exterior circumferential groove 416 on the outer surface of the substantially cylindrical midsection 413 to seal against leakage of fluid from the coolant passage 130. The first washer 158, which may comprise a copper ring, is received on the substantially cylindrical end portion 155 of the elongate tubular sleeve 151 and is seated in the recess 115, clamped between a floor of the coolant passage 130 and the first substantially cylindrical end portion 420 to prevent leakage of gas from the bore 114 to the coolant passage 130. The second washer 159, which may comprise a copper ring, is disposed within the elongate tubular sleeve 151, girding the nozzle 161 of the fuel injector 160, and clamped between the fuel injector 160 and an interior end wall of the substantially cylindrical midsection 413 of the elongate tubular sleeve 151 to prevent leakage of gas from the bore 114 to the atmosphere.

Reducing or eliminating deformation of the cylinder bore of an opposed-piston engine that is attributable to mounting a fuel injector is accomplished by the invention, as follows. With respect to FIG. 2, the arrows 170 show the clamping forces applied to retain the fuel injector 160 in place after installation of the fuel injector mounting assembly 150. A force applied to the clamp 152 by threaded fasteners 154 compels the clamp to exert a clamping force to act axially against the fuel injector 160, pushing it against the elongate tubular sleeve 151, toward the cylinder wall where the substantially cylindrical end portion 155 of the sleeve is threaded in the recess 115. However, the spanner nut 156, tightly threaded to the first threads 406 tends to pull the elongate tubular sleeve 151 away from the cylinder wall, thereby transferring some of the clamping load to the spanner nut 156, which is far away from the cylinder wall 116. Therefore, the combination of the elongate tubular sleeve 151 and the spanner nut 156, reduces or eliminates deformation of the cylinder bore 114, where the tip of the injector nozzle 161 is positioned at the aperture 163 in the cylinder wall to the cylinder bore 114. The threaded fasteners 154 attach to the cylinder block 110 at a distance away from the cylinder sidewall that is sufficient not to cause bulging and deformation of the bore. The width between the threaded fasteners 154 also prevents bore deformation.

Additionally, the seating configuration of the elongate tubular sleeve 151 allows for attachment of the fuel injector 160 to the cylinder block 110 while reducing, if not eliminating, adverse effects such as vibration modes in the fuel injector and fretting, and/or damage to any parts that operate a valve in the nozzle 161. In this regard, the elongate tubular sleeve 151 is anchored at the first of its ends to the cylinder block 110 by action of the spanner nut 156, and at the second of its ends by the threaded attachment of end 155. This prevents lengthwise and radial movement of the elongate tubular sleeve 151, thereby circumferentially buttressing the nozzle end of the fuel injector 160.

The fuel injector mounting assembly 150 can be implemented or installed onto a cylinder block 110 as follows. With reference to FIG. 2 and FIG. 3, the elongate tubular sleeve 151 is seated in the recess 115 with the substantially cylindrical end portion 155 of the elongate tubular sleeve 151 threaded into the recess end 115*e*. On the fuel injector 160, the clamp 152 slips over the injector body, abutting a fitting 163 of the injector where the fuel lines connect. Adjacent to the clamp 152, closer to the injector nozzle 161, the collar 153 is secured to the injector body. In this way, when the threaded fasteners 154 are threaded into the drillings 125 in the cylinder block 110, the clamp 152 exerts a clamping force on the fuel injector 160. The fuel injector 160 is received in the elongate tubular sleeve 151 and secured to the cylinder block 110 by the threaded fasteners 154. To service the fuel injector 160, the threaded fasteners 154 may be removed from the cylinder block 110 and the fuel injector 160 pulled out from the elongate tubular sleeve 151, while the sleeve 151 remains seated in the cylinder block 110. If issues arise with sealing the coolant passage 130, then the elongate sleeve 151 can be unthreaded from the cylinder block 110 and removed. Then, the elongate tubular sleeve 151, O-rings 157, and washers 158, 159 can be examined and serviced as needed. The spanner nut 156 may be threadedly detached from the elongate tubular sleeve 151 to allow the sleeve to be removed from the cylinder block 110.

As is evident from FIG. 1, the opposed-piston engine 100 is preferably configured with two fuel injectors 160 disposed for direct side injection into the cylinder 114. In this case, each fuel injector 160 may be mounted to the cylinder block 110 by means of a fuel injector mounting assembly according to the invention described hereinabove.

Opposed-piston engines may have a parent bore cylinder block construction. Alternatively, opposed-piston engine cylinders may comprise cylinder liners received in tunnels formed in the cylinder block. The fuel injector mounting assembly of the invention is applicable to either construction. A parent bore cylinder block of an opposed-piston engine includes cylinders cast in the block with features defining coolant paths that ensure effective thermal management of the cylinders when the engine operates. Parent bore cylinder block constructions do not comprise cylinder liners or cylinder sleeves. In opposed-piston engines with a cylinder liner construction, the cylinder liner sidewall is effectively at least a portion of the cylinder wall referred to hereinabove and the inner surface of the cylinder liner is the bore surface. In each cylinder of an opposed-piston engine with a cylinder liner construction, the pistons reciprocate in the liner. The fuel injector mounting assembly described herein may be used with opposed-piston engines of either parent bore or cylinder liner construction. In opposed-piston engines with a cylinder liner construction, the second threads 408 on the substantially cylindrical end portion 155 of the elongate tubular sleeve 151 may threadedly engage a threaded injection aperture in the liner, thereby serving to retain the liner in the cylinder block.

In the foregoing specification, embodiments have been described with reference to numerous specific details that can vary from implementation to implementation. Certain adaptations and modifications of the described embodiments can be made. Other embodiments can be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fuel injector mounting assembly for mounting a fuel injector to an opposed-piston engine cylinder block, the fuel injector mounting assembly comprising:

an elongate tubular sleeve configured to receive and sheathe at least a nozzle portion of the fuel injector;

the elongate tubular sleeve comprising a first end and a second end, the first end defining an opening for insertably receiving the nozzle portion and comprising first threads on a sleeve exterior surface portion at the first end, the second end configured to receive a nozzle of the nozzle portion and comprising second threads on a sleeve exterior surface portion at the second end;

a clamp with a first opening for the fuel injector and a plurality of openings to accommodate threaded fasteners;

a plurality of threaded fasteners configured to pass through the plurality of openings in the clamp and threadedly engage the cylinder block; and a spanner nut configured to threadedly engage the first threads at the first end of the elongate tubular sleeve;

in which the second threads are configured to threadedly engage interior threads of a cylinder wall portion in the cylinder block.

2. The fuel injector mounting assembly of claim 1, wherein the elongate tubular sleeve is further configured to be insertably received in a recess of the cylinder block that opens through the cylinder wall to an aperture to a cylinder bore.

3. The fuel injector assembly of claim 2, wherein the second threads are configured to be received in a threaded portion of the recess.

4. The fuel injector mounting assembly of claim 3, wherein the spanner nut is further configured to be received in and seat against an annular groove of the recess.

5. An opposed-piston engine, comprising:

a cylinder block including a recess extending through a cylinder wall of the cylinder block to a bore of a cylinder of the cylinder block;

a fuel injector mounted in the recess by an assembly comprising:

an elongate tubular sleeve received in the recess and configured to receive and sheathe at least a nozzle portion of the fuel injector in the recess;

the elongate tubular sleeve comprising a first end and a second end, the first end defining an opening for insertably receiving the nozzle portion and comprising first threads on a sleeve exterior surface portion at the first end, the second end configured to position a nozzle of the nozzle portion in the recess and comprising second threads on a sleeve exterior surface portion at the second end;

clamping means for clamping the fuel injector to the cylinder block; and, a spanner nut threadedly engaging the first threads and positioned on the cylinder block to resist a clamping force exerted on the elongate tubular sleeve by the clamping means;

in which the second threads threadedly engage interior threads of the recess.

6. The opposed-piston engine of claim 5, wherein the cylinder block comprises a parent bore cylinder block.

7. The opposed-piston engine of claim 5, wherein the cylinder block comprises a cylinder liner received in a cylinder tunnel of the cylinder block.

8. The opposed-piston engine of claim 5, the elongate tubular sleeve comprising a shape in which:

an upper substantially cylindrical portion comprising the first threads tapers through a first generally frusto-conical shoulder portion to a substantially cylindrical midsection;

an exterior circumferential groove is formed in the substantially cylindrical midsection; and, the substantially cylindrical midsection tapers through a second generally frusta-conical shoulder portion to a first substantially cylindrical end portion, which steps down to a second, narrower substantially cylindrical end portion comprising the second threads; wherein, the shape enables the elongate tubular sleeve to receive and sheathe a nozzle end of the fuel injector, with a nozzle of the fuel injector disposed in the second substantially cylindrical end portion.

9. The opposed-piston engine of claim 8, further comprising a coolant passage in the cylinder block and an O-ring received in the exterior circumferential groove to seal against leakage of fluid from the coolant passage.

10. The opposed-piston engine of claim 8, further comprising a coolant passage in the cylinder block and a first washer received on the substantially cylindrical end portion and seated in the recess, and clamped between a floor of the coolant passage and the first substantially cylindrical end portion to prevent leakage of gas from the bore to the coolant passage.

11. The opposed-piston engine of claim 8, further comprising a coolant passage in the cylinder block and a second washer disposed within the elongate tubular sleeve, girding the nozzle of the fuel injector, and clamped between the fuel injector and an interior end wall of the substantially cylindrical midsection to prevent leakage of gas from the bore to the atmosphere.

12. A combination, comprising:

an opposed-piston engine cylinder block;

at least one cylinder in the cylinder block, the cylinder being adapted to support two oppositely-moving pistons in a bore thereof;

a pair of fuel injectors positioned on opposite sides of the cylinder for injection of fuel into a bore of the cylinder; and, each fuel injector of the pair of fuel injectors being mounted to the cylinder block by a fuel injector mounting assembly comprising:

an elongate tubular sleeve with a first end and a second end, the first end defining an opening for insertably receiving the nozzle portion and comprising first threads on a sleeve exterior surface portion at the first end, the second end configured to position a nozzle of the nozzle portion in the recess and comprising second threads on a sleeve exterior surface portion at the second end, clamping means for clamping the fuel injector to the cylinder block; and, a spanner nut threadedly engaging the first threads and positioned on the cylinder block to resist a clamping force exerted on the elongate tubular sleeve by the clamping means;

in which the second threads threadedly engage interior threads of the recess.

13. The combination of claim 12, the elongate tubular sleeve comprising a shape in which:

an upper substantially cylindrical portion comprising the first threads tapers through a first generally frusta-conical shoulder portion to a substantially cylindrical midsection;

an exterior circumferential groove is formed in the substantially cylindrical midsection; and, the substantially cylindrical midsection tapers through a second generally frusta-conical shoulder portion to a first substantially cylindrical end portion, which steps down to a second, narrower substantially cylindrical end portion comprising the second threads; wherein, the shape enables the elongate tubular sleeve to receive and sheathe a nozzle end of the fuel injector, with a nozzle of the fuel injector disposed in the second substantially cylindrical end portion.

14. The combination of claim 13, further comprising a coolant passage in the cylinder block and an O-ring received in the exterior circumferential groove to seal against leakage of fluid from the coolant passage.

15. The combination of claim 13, further comprising a coolant passage in the cylinder block and a first washer received on the substantially cylindrical end portion and seated in the recess, and clamped between a floor of the coolant passage and the first substantially cylindrical end portion to prevent leakage of gas from the bore to the coolant passage.

16. The combination of claim 13, further comprising a second washer disposed within the elongate tubular sleeve, girding the nozzle of the fuel injector, and clamped between the fuel injector and an interior end wall of the substantially cylindrical midsection to prevent leakage of gas from the bore to the atmosphere.

17. The combination of claim 14, further comprising a first washer received on the substantially cylindrical end portion and seated in the recess, and clamped between a floor of the coolant passage and the first substantially cylindrical end portion to prevent leakage of gas from the bore to the coolant passage.

18. The combination of claim 17, further comprising a second washer disposed within the elongate tubular sleeve, girding the nozzle of the fuel injector, and clamped between the fuel injector and an interior end wall of the substantially cylindrical midsection to prevent leakage of gas from the bore to the atmosphere.

19. The combination of claim 12, wherein the cylinder block comprises a parent bore cylinder block.

20. The combination of claim 12, wherein the cylinder block comprises a cylinder liner received in a cylinder tunnel of the cylinder block.

* * * * *